US005979352A

United States Patent [19]

Pearcy et al.

[11] Patent Number: 5,979,352

[45] Date of Patent: Nov. 9, 1999

[54] DOCK SYSTEM STORAGE DEVICE

[75] Inventors: Meredith M. Pearcy; Timothy E. Pearcy, both of Minnetonka, Minn.

[73] Assignee: Lake Home Products LLC, Minnetonka, Minn.

[21] Appl. No.: 08/862,808

[22] Filed: May 23, 1997

[51] Int. Cl.[6] ..... B63B 35/44

[52] U.S. Cl. ..... 114/263

[58] Field of Search ..... 114/258, 263, 114/264, 265, 266, 343

[56] References Cited

U.S. PATENT DOCUMENTS

| | | | |
|---|---|---|---|
| 1,700,153 | 1/1929 | Bradley . | |
| 1,871,475 | 8/1932 | Smith | 114/263 |
| 2,887,975 | 5/1959 | Smith | 114/263 |
| 3,166,037 | 1/1965 | Otis | 114/352 |
| 3,272,578 | 9/1966 | Money . | |
| 3,602,925 | 9/1971 | Thompson | 114/263 |
| 3,765,740 | 10/1973 | Mastrangelo . | |
| 3,846,002 | 11/1974 | Floetotto . | |
| 4,666,220 | 5/1987 | Bucaille et al. . | |
| 4,683,901 | 8/1987 | Mitchell . | |
| 4,690,467 | 9/1987 | Imbert . | |
| 5,199,370 | 4/1993 | Berquist . | |
| 5,419,273 | 5/1995 | Cutler | 114/263 |
| 5,445,093 | 8/1995 | Lilly | 114/263 |

*Primary Examiner*—Stephen Avila
*Attorney, Agent, or Firm*—Merchant & Gould P.C.

[57] ABSTRACT

A dock system storage device includes a base and an enclosure including doors at one side. The enclosure is constructed of laminated panels connecting at their edges to connecting channel members. The storage device has a width and length substantially equal to dock system sections. The storage device connects to an edge of the dock system with connectors below an upper surface of the dock sections. The storage device includes legs or pontoons supporting the device independently of the dock sections.

15 Claims, 15 Drawing Sheets

DOCK SYSTEM STORAGE DEVICE

BACKGROUND

1. Field of the Invention

The present invention is directed to a temporary storage device which may be utilized as part of a marine dock system, and in particular to a portable modular storage device.

2. Prior Art

Devices for storing marine related articles at the water side are well known. Permanent structures such as boat houses are often used for storage of boats and other equipment. It can be appreciated that on beaches and waterfront property, there are often many types of water toys and recreational equipment such as water-skis, life jackets, fishing gear and other articles that may be utilized in the water and which require storage. If there is no storage available at the water side, the equipment must be carried back and forth between storage space remote from the waterfront or placed in a boat which typically does not have adequate storage space.

In addition to permanent boat houses, dock storage boxes are utilized for storing equipment on a dock. However, the on-dock devices are not affixed to the dock in any manner and although they may provide protection for the equipment from the elements, the dock storage boxes do not provide an adequate level of security. Moreover, the storage capacity of dock boxes is very limited, requiring either several boxes for storing multiple pieces of equipment or requiring alternatives storage for larger items. Dock storage devices also generally sit on a dock, reducing the walk path available on the dock. This creates inconveniences and possible safety hazards.

Although permanent structures such as boathouses may provide adequate storage, such structures have several drawbacks. The permanent boat houses may be very costly to construct and maintain. In addition to the cost, the permanent structure may require a permit to build and occupy space along the beach. In many states, zoning regulations require that the permanent structure must be set back a predetermined distance from the waterfront, thereby decreasing the accessibility and convenience of such a structure. However, removable non-permanent devices such as boat lifts and their covers generally do not require a permit and are removable with the dock.

It can be seen then, that a new and improved storage device for use at the waterfront with a dock is needed. Such a device should provide adequate storage capacity while providing protection from the elements. In addition, such a device should not obstruct the open space on the dock. The device should be constructed of lightweight, low maintenance materials and be easily removable and portable along with other components of the dock system so it does not require a special permit.

Moreover, such a device may be modular for adapting to standard dock configurations. The present invention addresses these problems as well as others associated with waterfront storage devices.

SUMMARY OF THE INVENTION

The present invention is directed to a storage container device used in a dock system. A modular dock storage unit is utilized with standard docks which are generally comprised of several sections attached in an end-to-end configuration for forming an extended dock over the water.

The dock storage device of the present invention includes an enclosure having opposed doors opening to one side. The enclosure is weather and water proof and includes is a base having an eight foot length which is substantially the same as standard dock sections. This configuration provides ample storage capacity and a modular capability which can be combined with other dock sections and systems. Separate but similar support systems are typically used for the modular storage system and the dock. The modular storage unit is also connectable to an adjoining dock system to provide for added support.

The storage device is easily transported to its use location and easily removed along with the dock sections. The storage enclosure is lightweight providing for easy lifting and movement between insertion and removal, as is needed during the winter months in cold climates.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT

Figure 1:
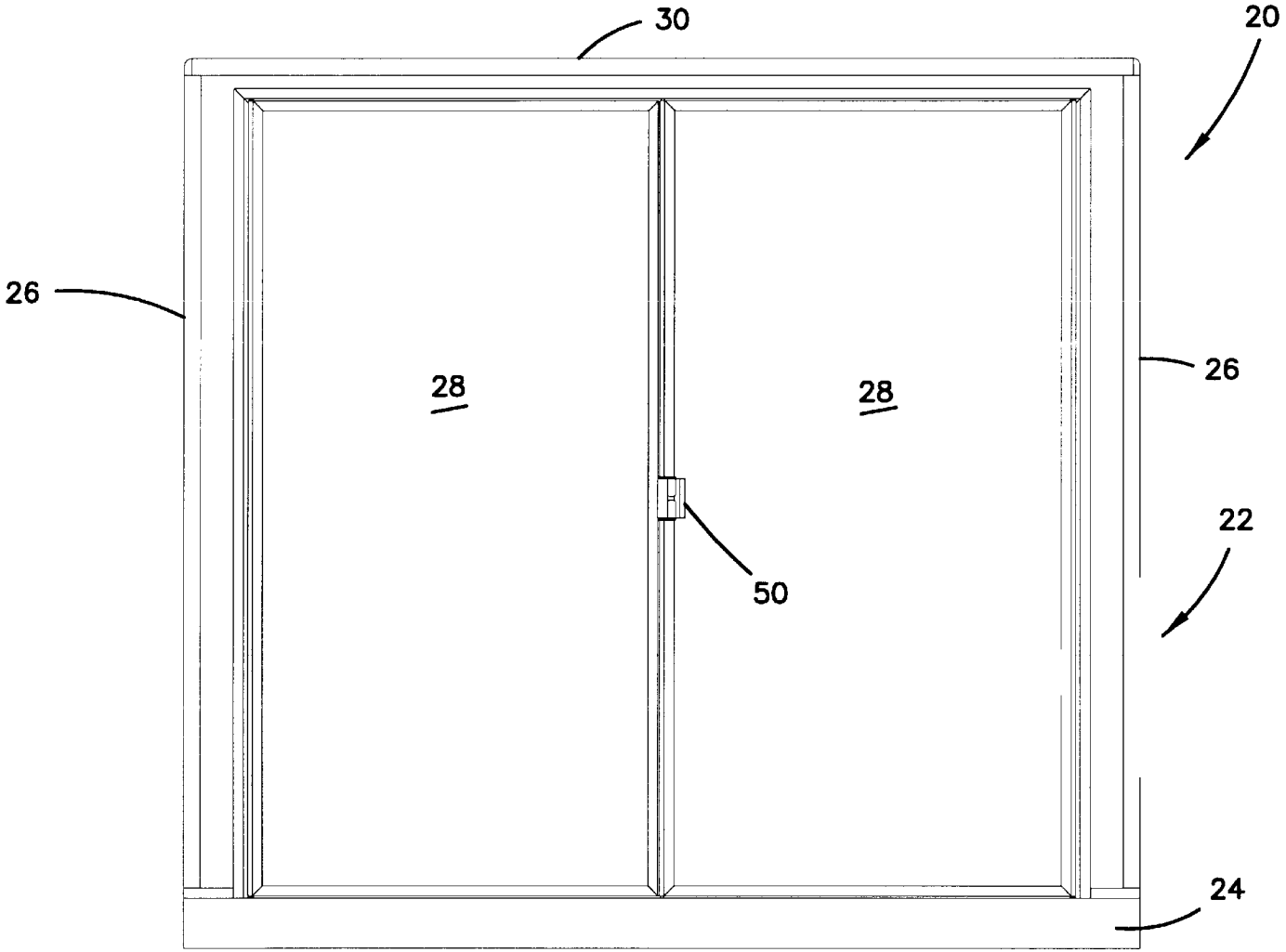
FIG. 1 shows a front elevational view of a storage device for a marine dock according to the principles of the present invention.
Figure 2:
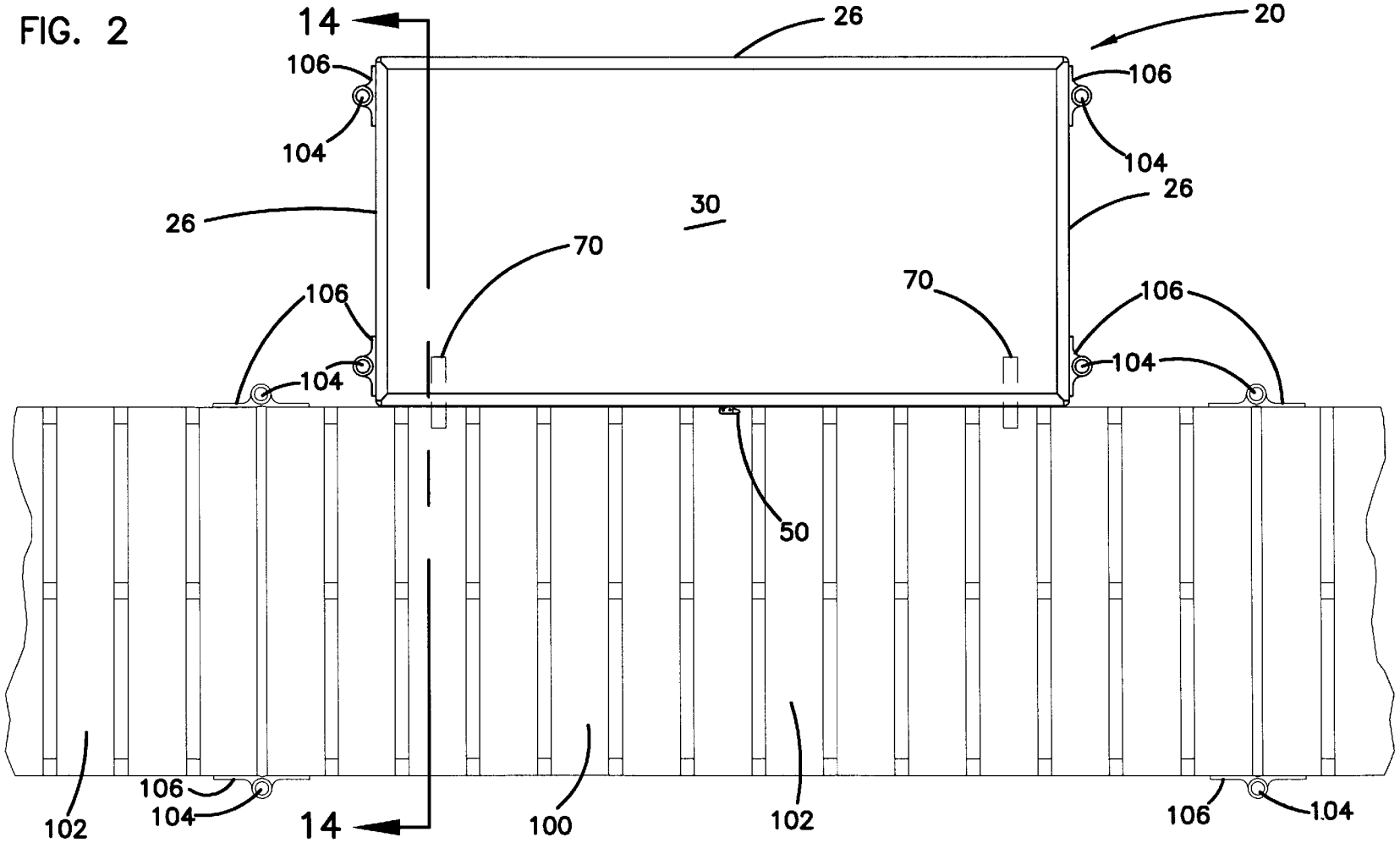
FIG. 2 shows a top plan view of the storage device shown in FIG. 1 connected to a dock structure.
Figure 3:
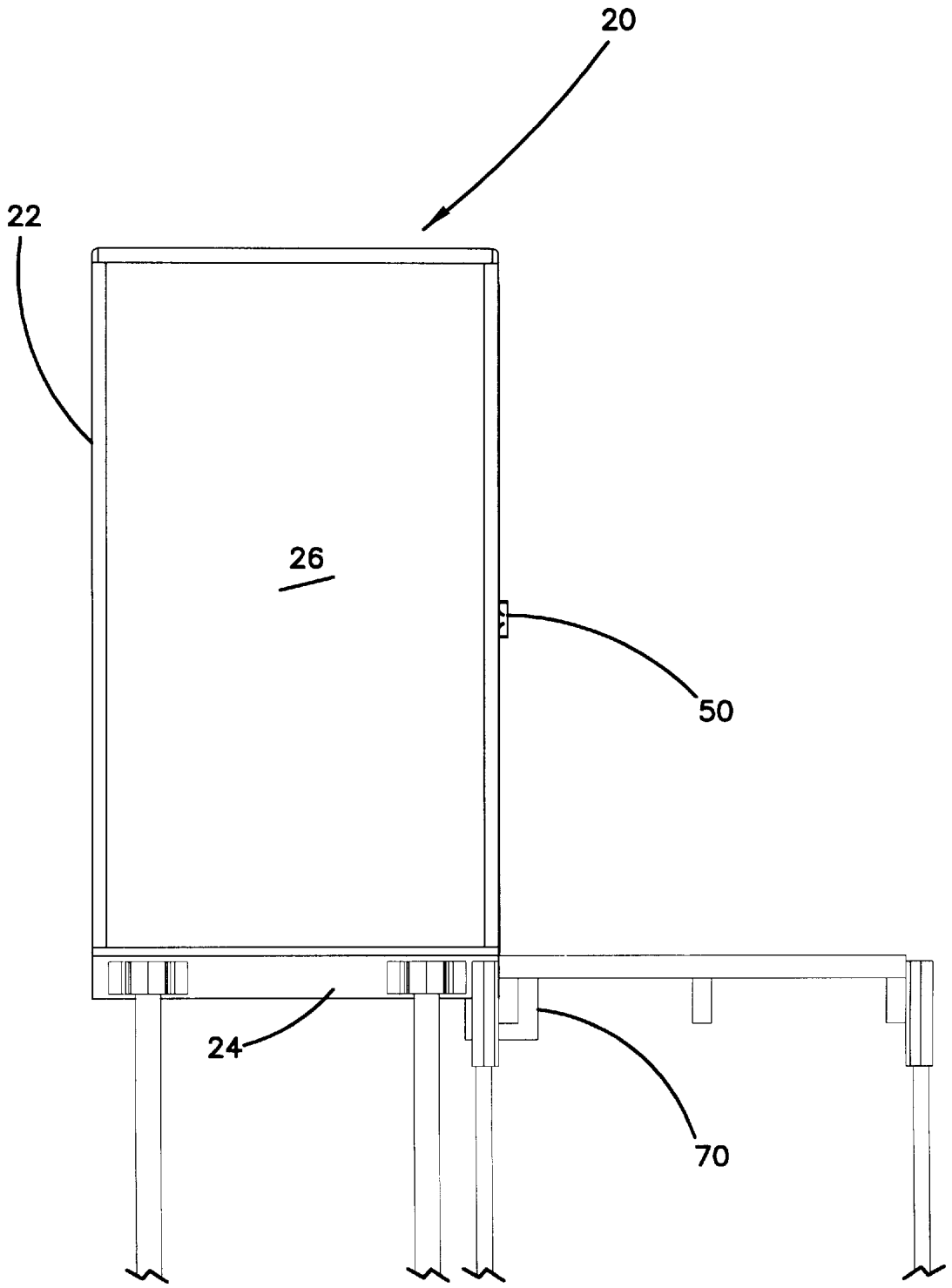
FIG. 3 shows a left side elevational view of the storage device shown in FIG. 1 connected to a dock structure.

Referring now to the drawings, wherein like reference letters and numerals indicate corresponding structure throughout the several views, and in particular to FIG. 1, there is shown a storage device, generally designated 20. The storage device 20 is utilized with a dock or pier usually extending over the water, as shown in FIG. 3. The storage device 20 is self-contained and self-supporting, but is configured for access from the dock through access doors 28. The storage device 20 includes an enclosure or container 22 mounted on a base 24, making the storage device 20 modular and self contained. The enclosure 22 includes sides 26, a top 30 and opposed opening doors 28 connected at the center by a latch 50, as shown in FIGS. 1–3.

Figure 4:
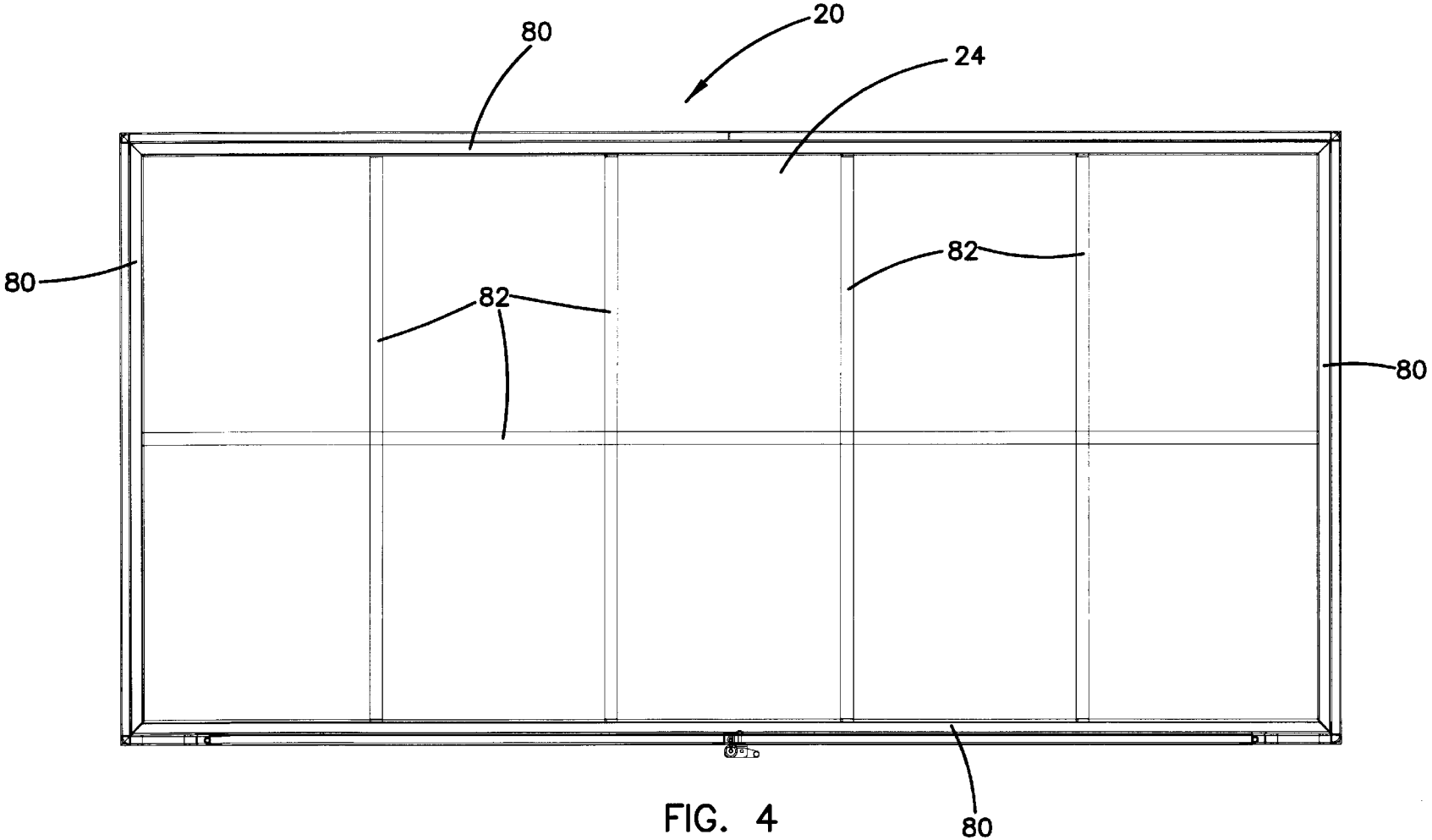
FIG. 4 shows a top plan view of the storage device base frame shown in FIG. 1.

Referring now to FIG. 4, the base 24 includes a base frame 80, preferably constructed of a lightweight tubing, such as aluminum, which is also resistant to wear and weathering due to the marine environment. Cross channels 82 connect the frame 80 to provide a lightweight yet strong support base. It is important that the storage device 20 be lightweight for easy placement and removal.

Figure 5:
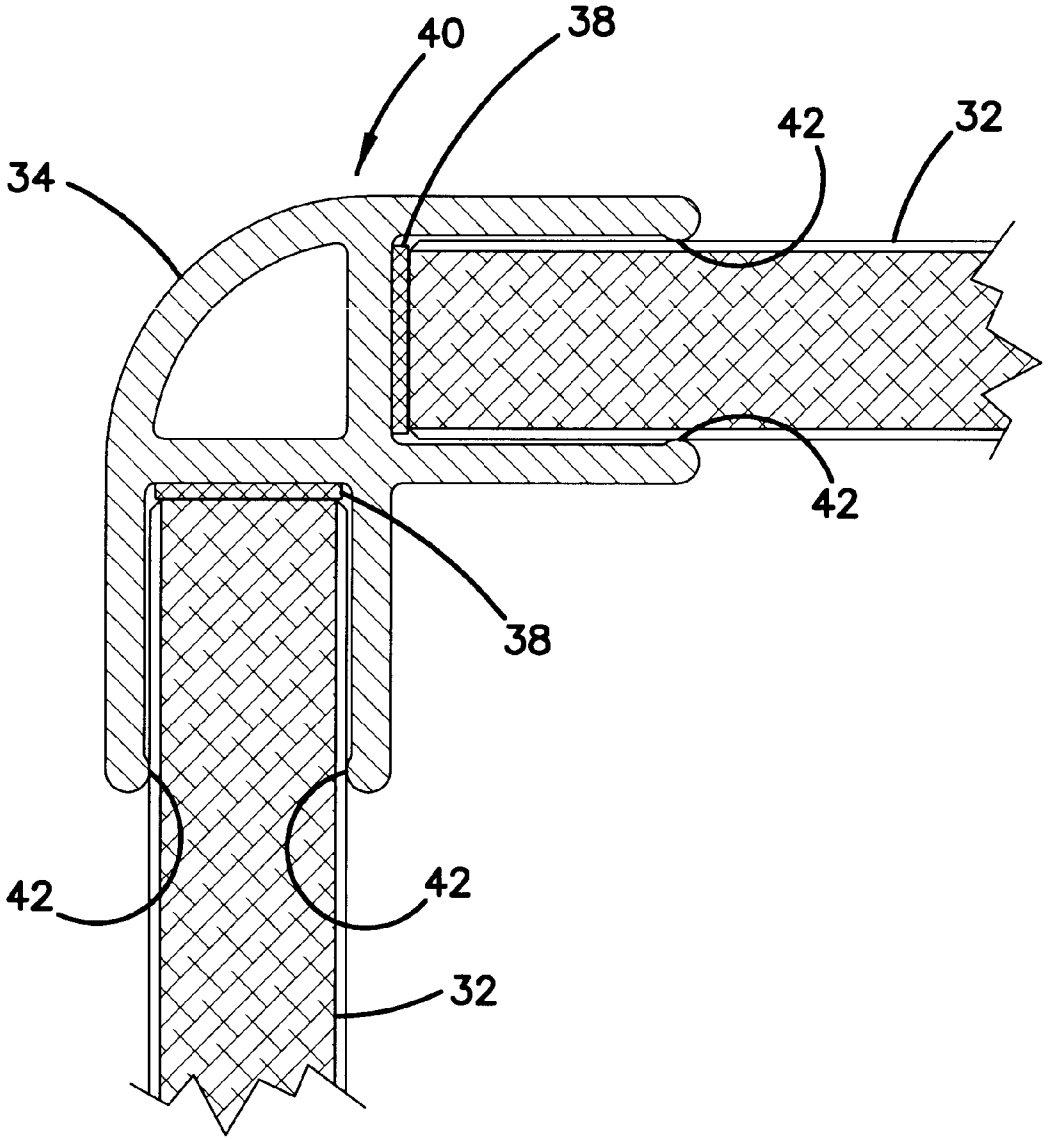
FIG. 5 shows a sectional detail view of an edge of the storage device shown in FIG. 1.
Figure 6:
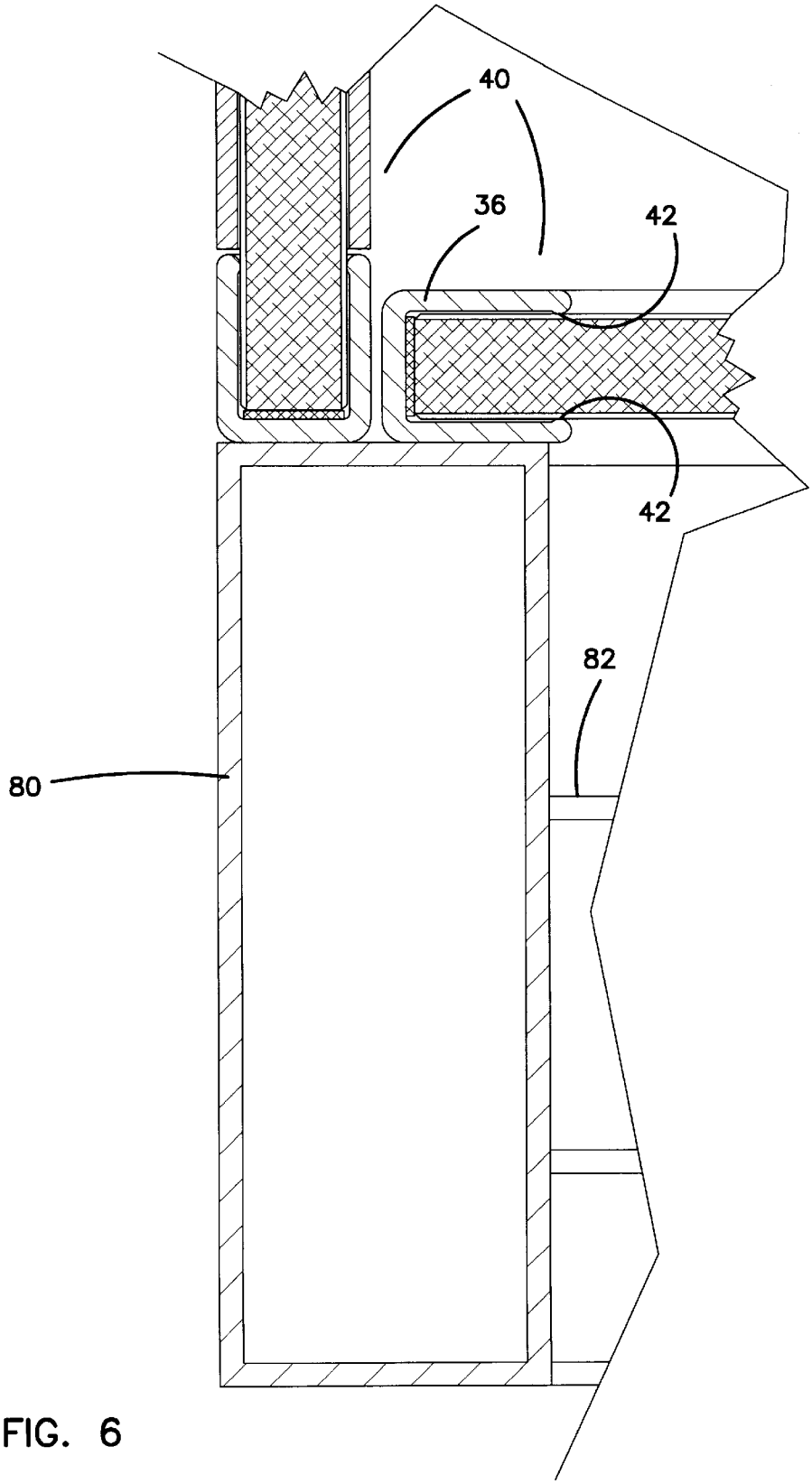
FIG. 6 shows a sectional detail view of enclosure mounting to the base of the storage device shown in FIG. 1.

Referring now to FIGS. 5 and 6, there are shown details of the construction for the storage device 20. The sides, top and doors of the container 22 are constructed of panels 32 including a lightweight center core with laminated, weather resistant outer surfaces. The outer covering of the panels 32 is typically a thin polymer, aluminum skin, fiberglass reinforced plastic or similar material. The panels 32 insert into aluminum channels 36 and extruded edge channels 34 making up the frame 40. An adhesive 38 maintains the ends of the panels 32 against the channels 34 and 36. The channels 34 and 36 include inward extending fingers 42 which act as barbs to counteract movement of the panels 32 out of the channels 34 and 36. It can be appreciated that the extruded channels and laminated panels provide for a rugged, lightweight and easy to manufacture enclosure. It can be further appreciated that the rounded edges 34 lessen wind resistance of the enclosure 22, which is seven feet high in a preferred embodiment. As the storage device 20 is one unit of a typical modular dock system, the storage device base 24 is eight feet long and four feet wide in a preferred embodiment, the same dimensions as a typical dock section.

Figure 15:
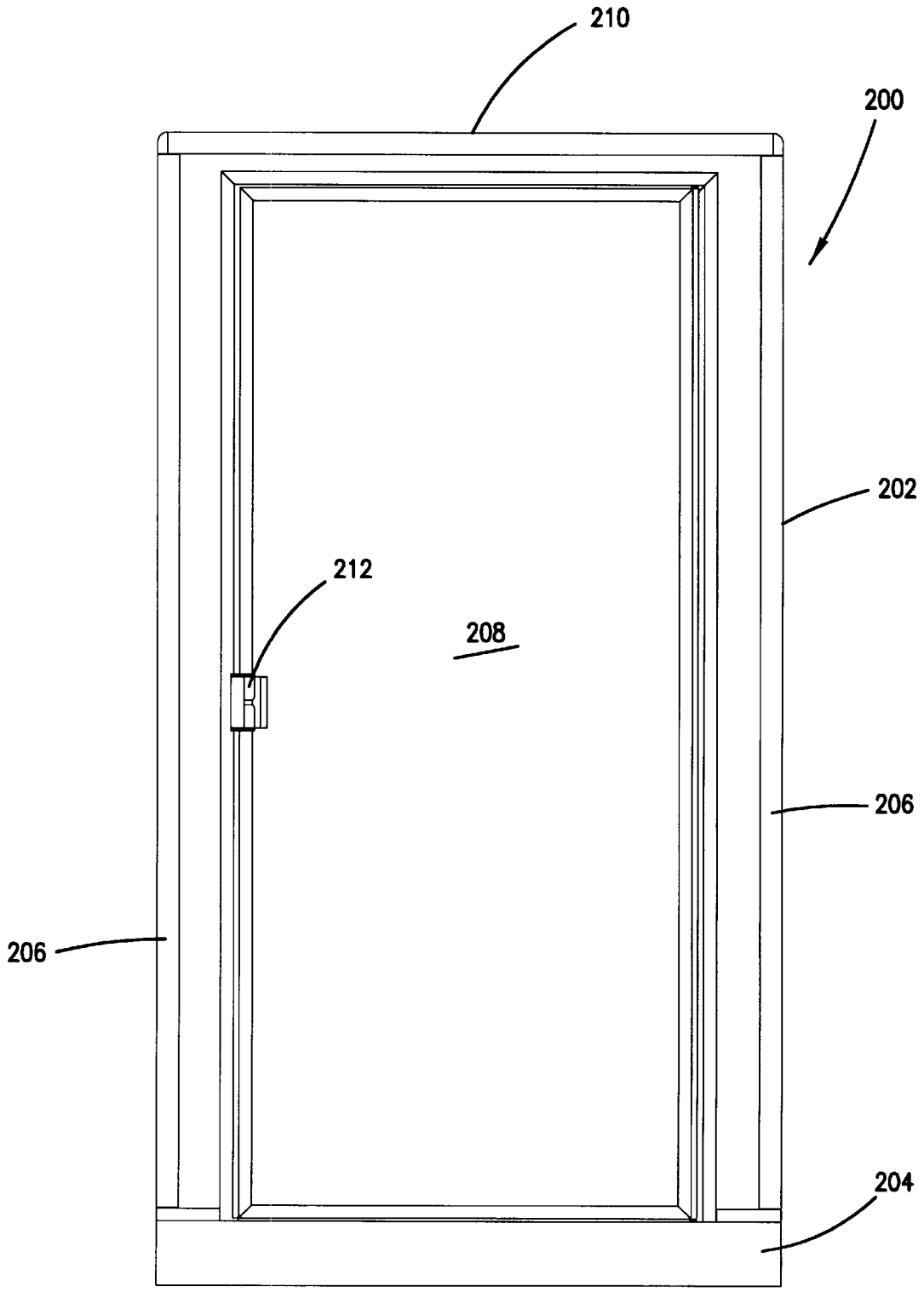

Referring now to FIG. 15, there is shown a second embodiment of a storage device, generally designated 200. The storage device 200 includes an enclosure 202 and a 10 base 204. In addition, the enclosure 202 includes sides 206, a top 210, and a single door 208 having a latch 212.

It can be appreciated that the storage device 200 is similar to the storage device 20 except that the storage device 200 is one half as long, typically four feet long and four feet is wide rather than eight feet long and four feet wide as is the storage device 20. The storage device 200 is self-contained and provides its own base 204 and is a modular component for fitting into areas where a full sized storage device 20 is not needed or cannot be accommodated. It can 20 also be appreciated that the storage device 200 and the storage device 20 may be combined to provide more storage volume and conform to the space requirements and allowances of each particular dock system.

Figure 7:
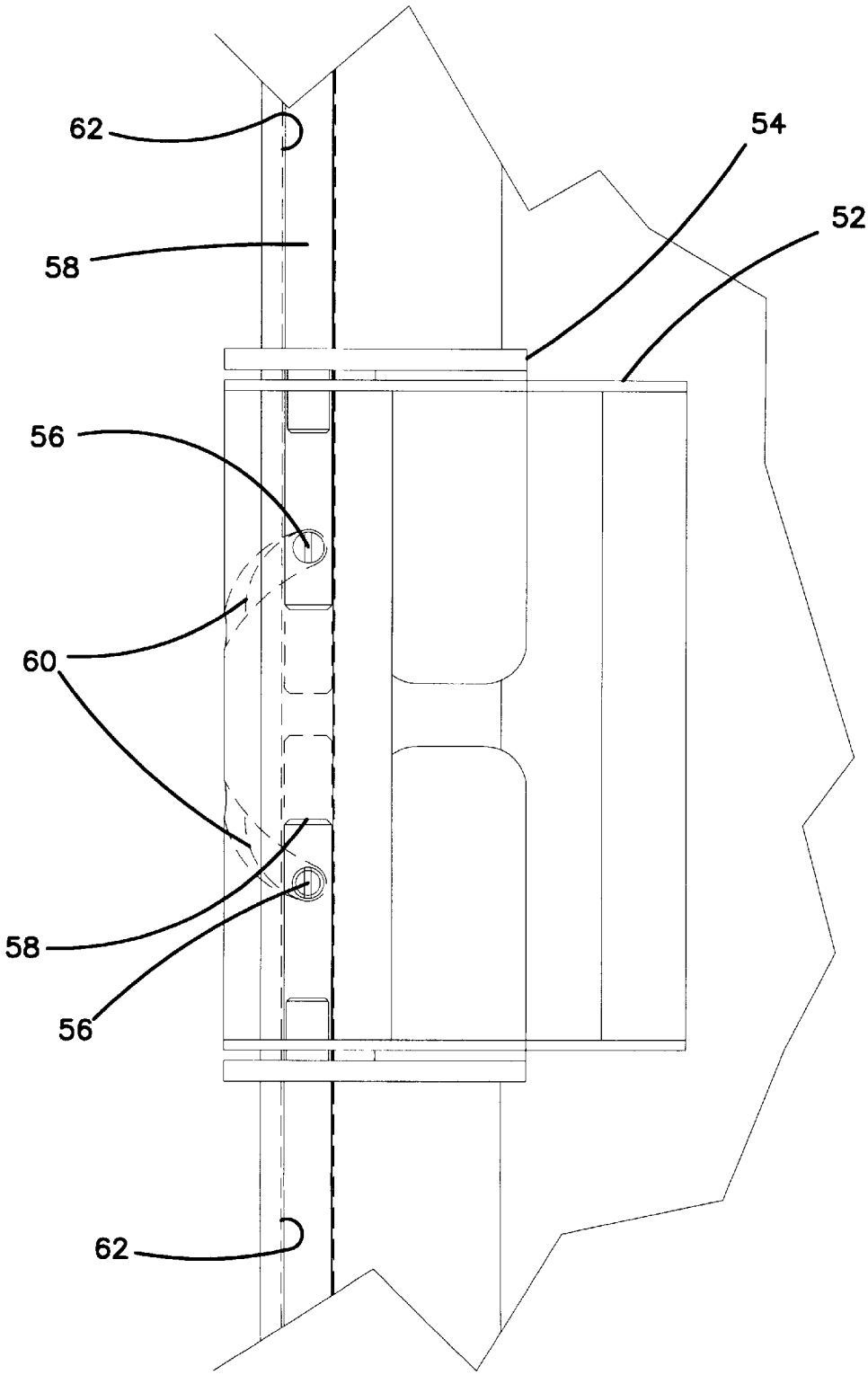
FIG. 7 shows a front detail view of the latch for the storage device shown in FIG. 1.
Figure 8:
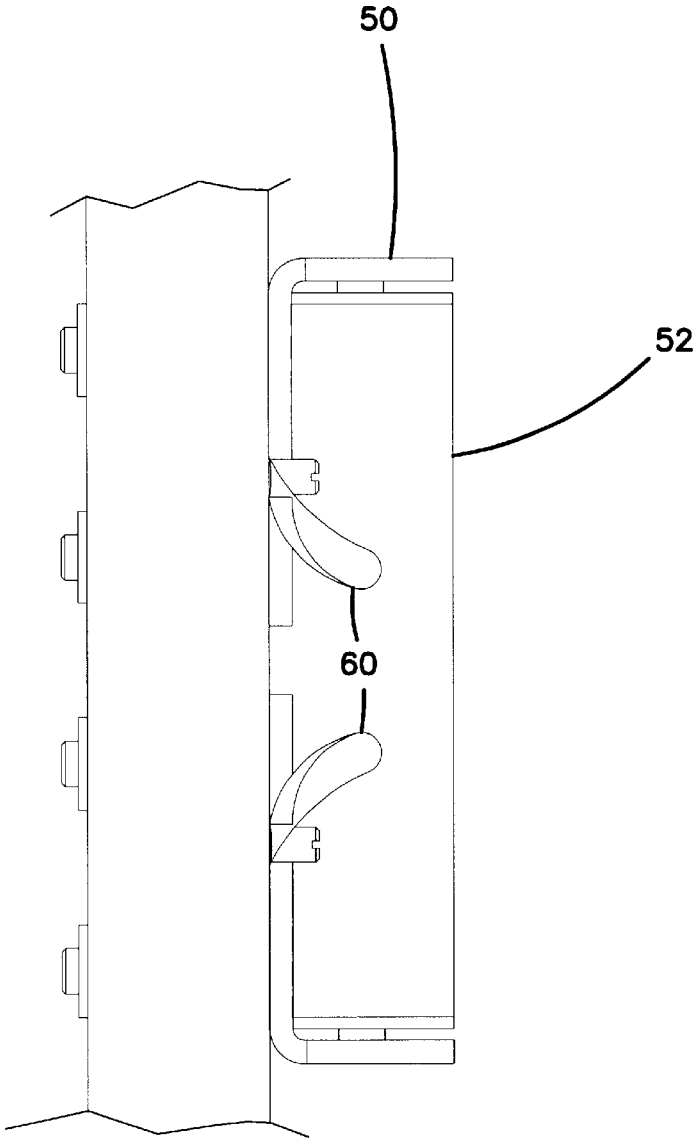
FIG. 8 shows a left side detail view of the latch shown in FIG. 5.
Figure 9:
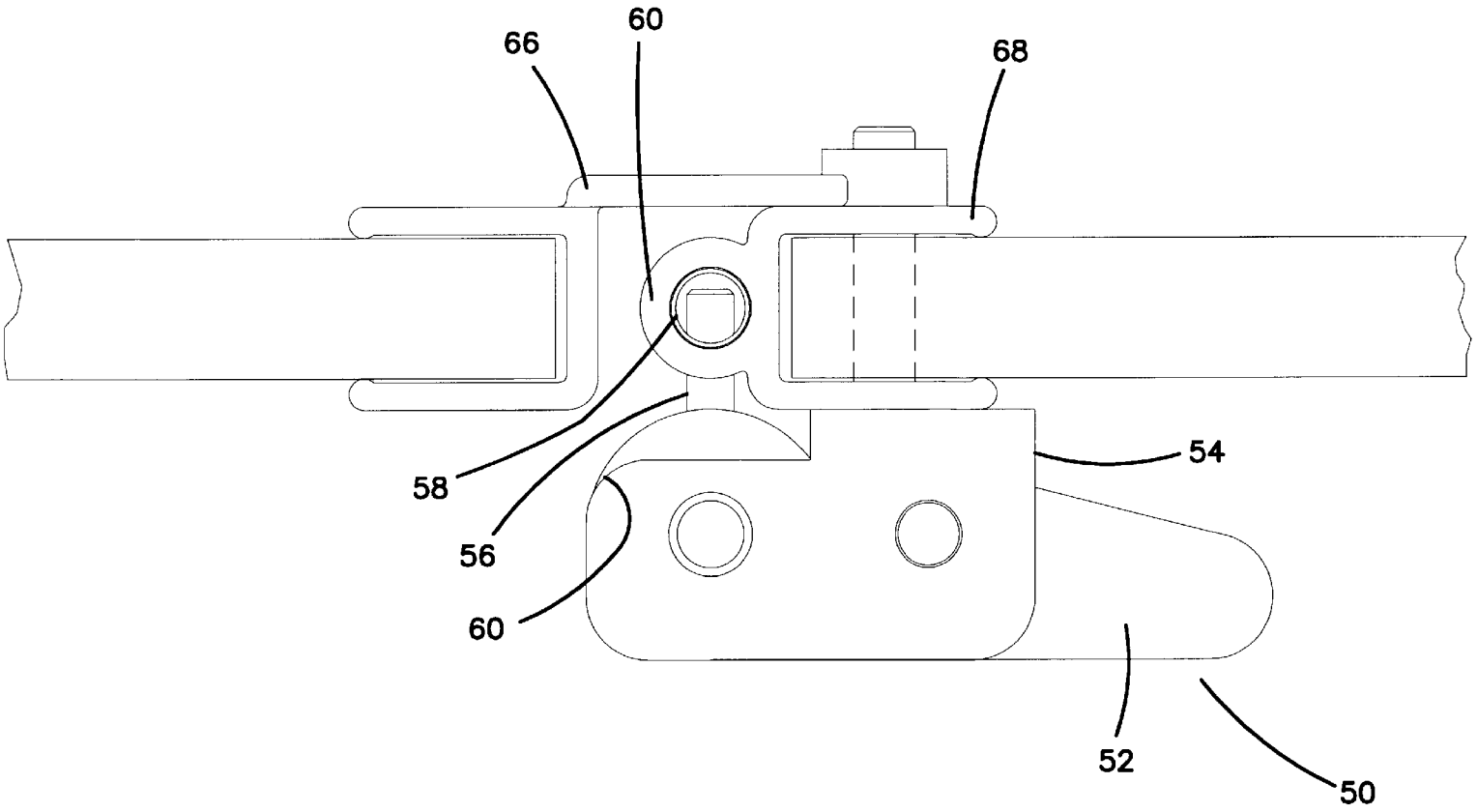
FIG. 9 shows a top plan detail view of the latch shown in FIG. 5.
Figure 13:
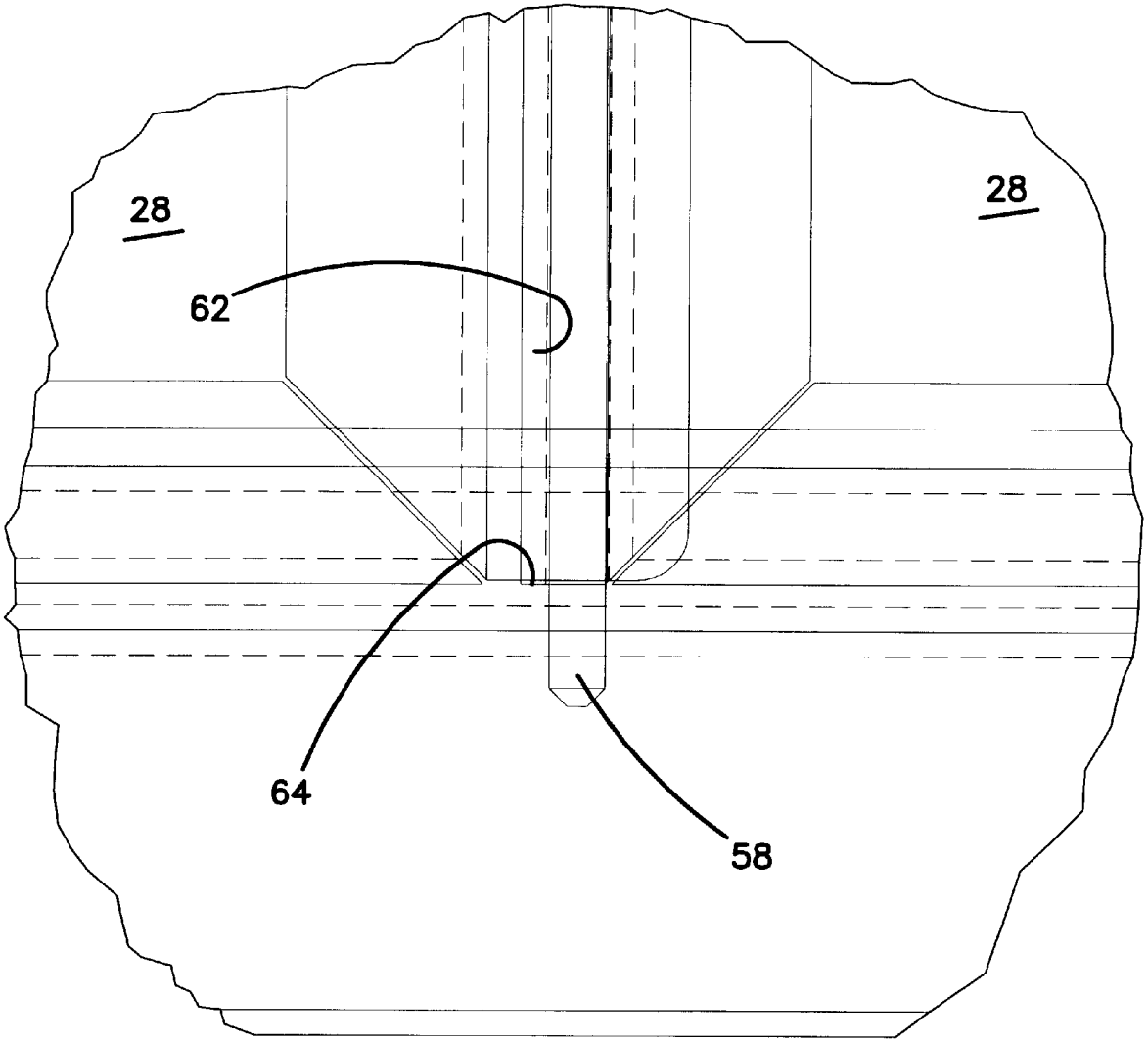
FIG. 13 shows a front detail view of the latch rod and frame engagement.

Referring now to FIGS. 7–9, the latch 50 for the 25 storage device 20 is shown. The latch 50 includes a latch handle 52 pivoting outward to release the doors 28. The latch 50 includes a mounting bracket 54 mounting to one of the doors with a flange 66 extending behind the edge of the opposite door to retain both doors 28 when latched. The latch bracket 54 is typically bolted to one of the doors 28 for ease of installation. Latch rods 58 are moved vertically to engage a recess 64 at the top and bottom of the enclosure 22 for retaining the doors in a closed position, as shown in FIG. 13. Referring again to FIGS. 7–9, each of the latch rods 58 includes a latch pin 56 extending substantially horizontally outward therefrom. The latch pins 56 are guided in latch pin channels 60 formed in a partial spiraling path along an arcing portion of the handle 52. It can be appreciated that as the latch handle 52 is rotated, the channels 62 move relative to the latch pins 56. Since the channels 62 curve vertically inward, the pins 56 move toward one another, thereby lifting the lower latch rod and lowering the upper latch rod 58. This motion retracts the latch rods 58 shown in FIG. 13 out of the recesses 64 to free the doors 28. At this point, the doors 28 may be freely opened. When the latch handle is closed, the latch pins 56 are forced away from one another, thereby forcing the latch pin 56 and the upper latch rod 58 upward and the lower latch pin and lower latch rod 58 downward into position engaging the recesses 60.

Figure 10:
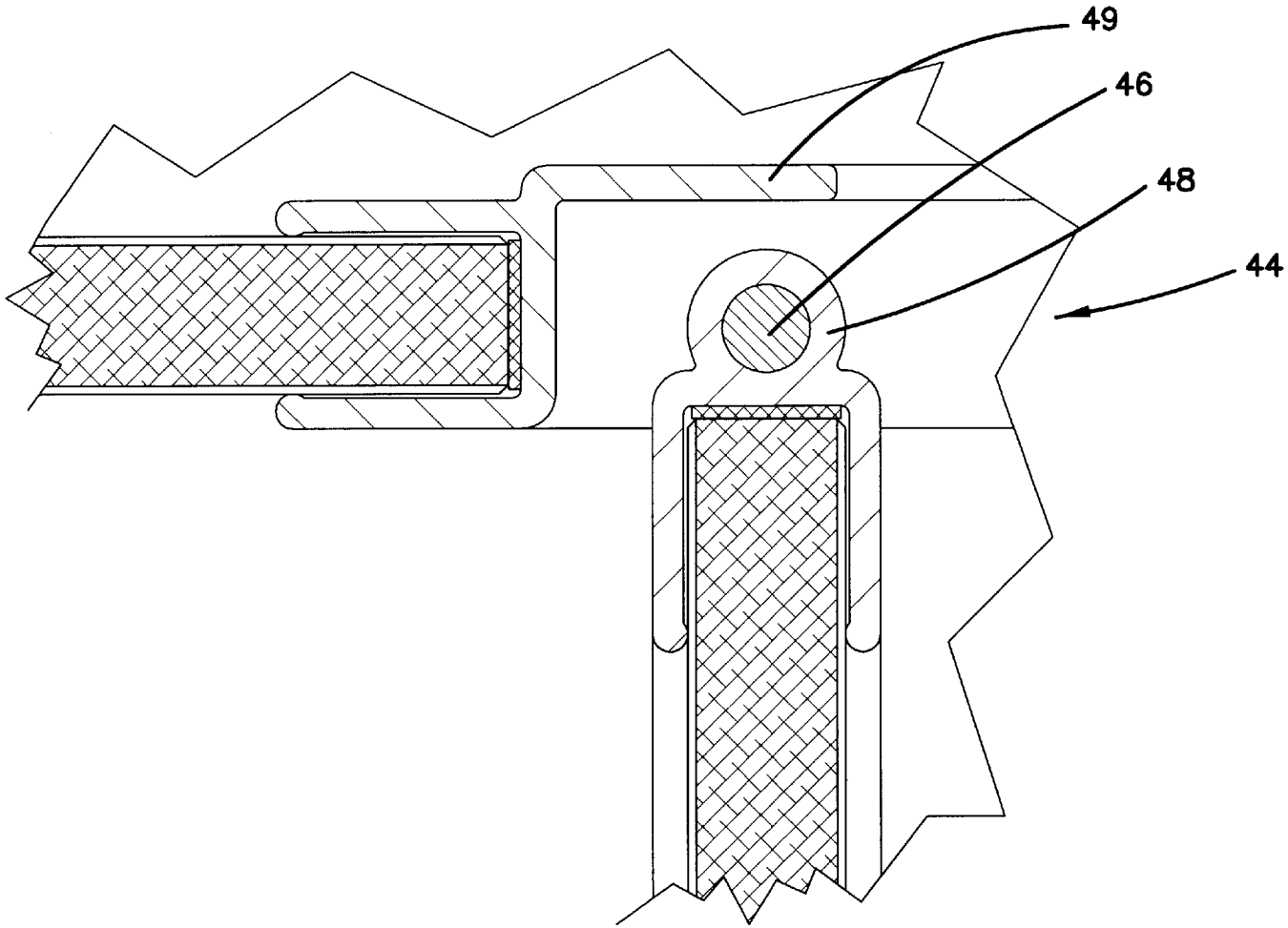
FIG. 10 shows a top detail sectional view of the frame and a door hinge for the storage device shown in FIG. 1.
Figure 11:
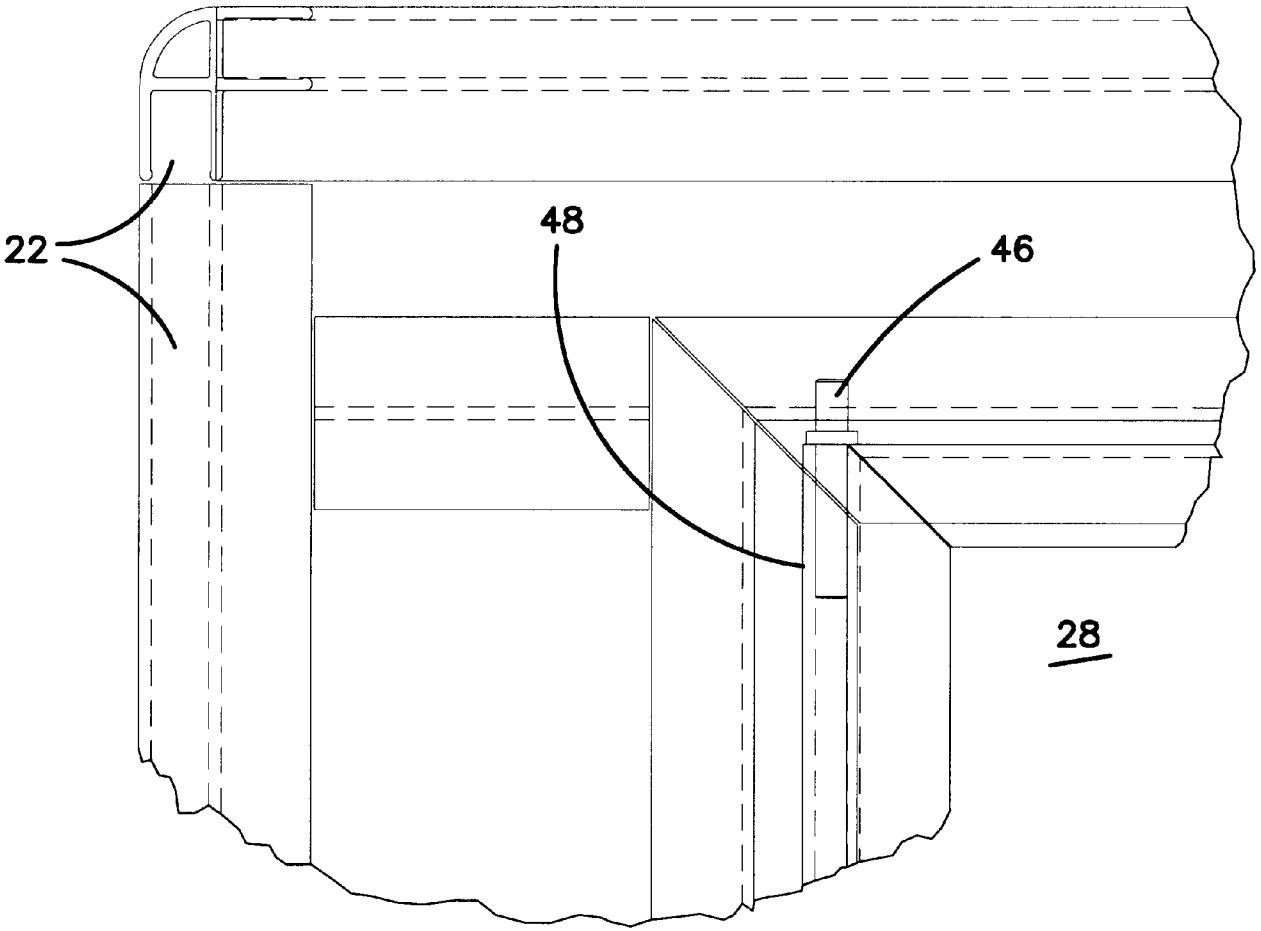
FIG. 11 shows a front detail view of the frame and a door hinge.

Referring to FIGS. 10 and 11, there is shown a hinge 44 for the doors 28. The hinge 44 includes a hinge pin engaging a recess in the enclosure 22. The hinge pin inserts into an extruded channel having a pin receiving portion 48 which pivots relative to an extruded channel 49 having a flange extending outward.

Figure 12:
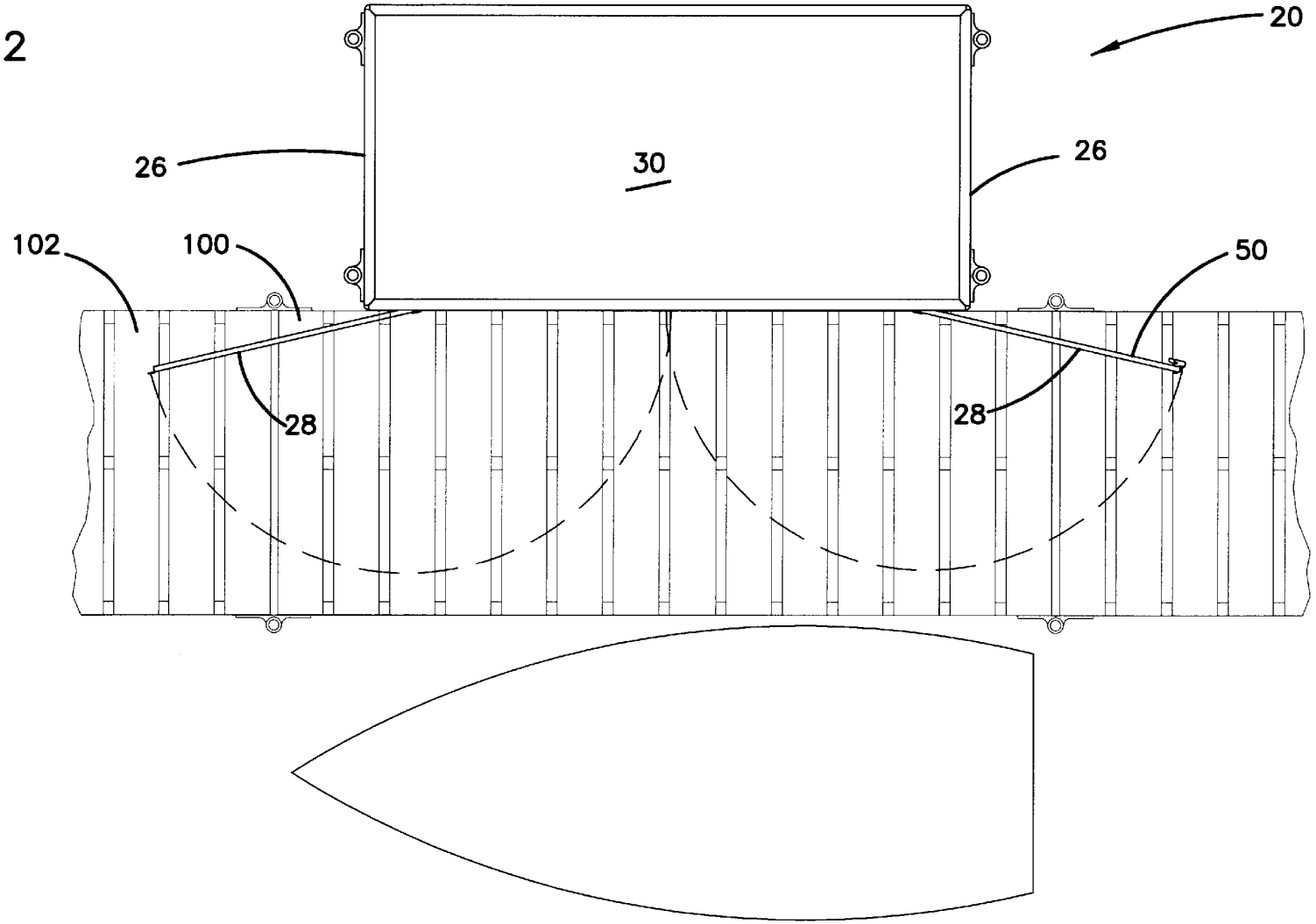
FIG. 12 shows a top plan view of the storage device shown in FIG. 1 connected to a dock structure with the doors open.
Figure 14:
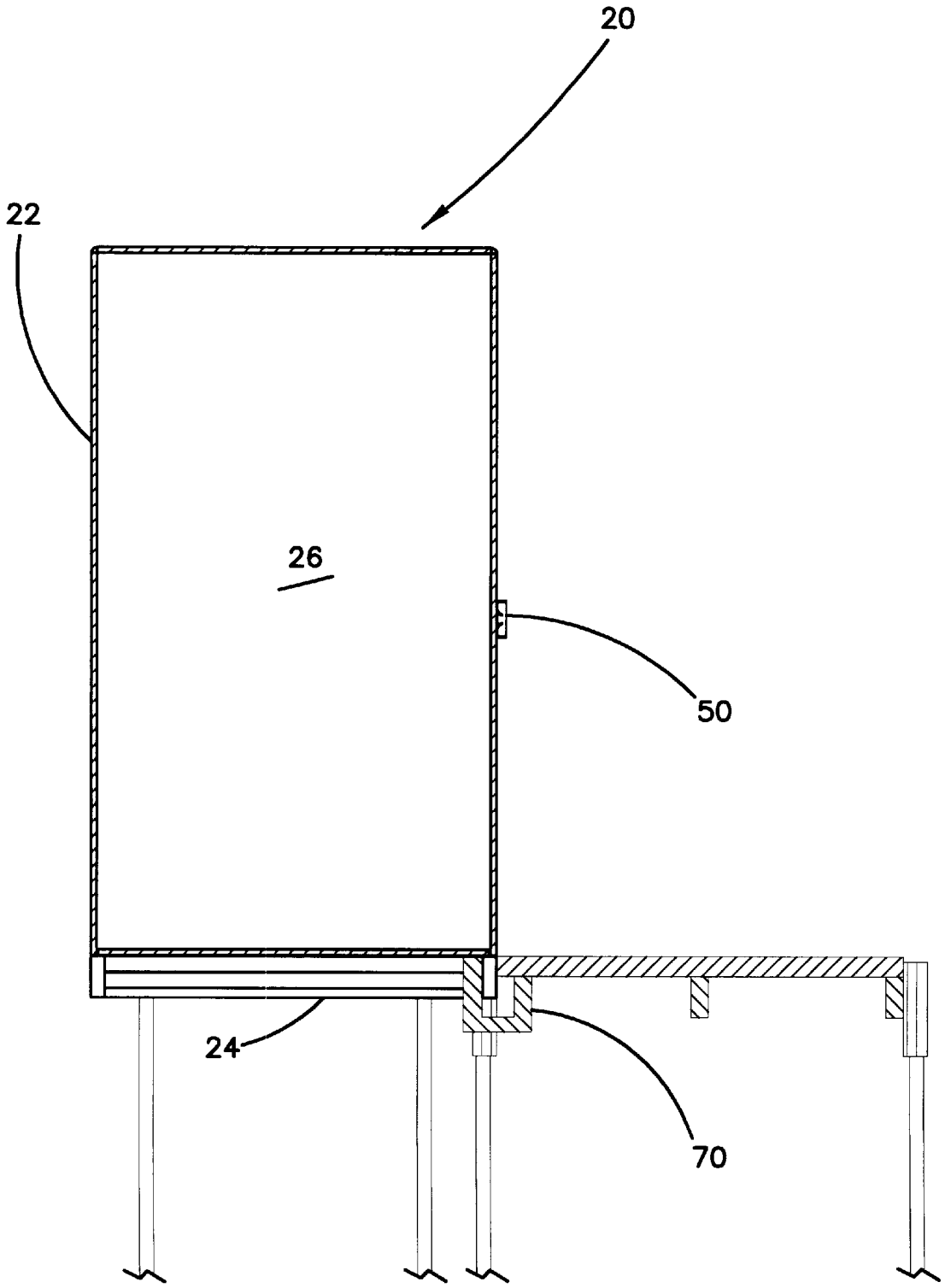
FIG. 14 shows a sectional view taken along line 14—14 of FIG. 2; and, FIG. 15 shows a front elevational view of a second embodiment of a storage device for a marine dock according to the principles of the present invention.

Referring now to FIGS. 3, 12 and 14, the storage device 20 is placed next to and is connectable to a dock 100. The storage device 200 connects in the same manner. The dock 100 typically has modular sections 102, typically four feet wide by eight feet long. The dock sections 102 are connected in and end-to-end configuration, as well as in layouts forming a right angle, a tee, or a layout forming one or more slips for boats. Support legs 104 extend downward from the dock 100 and support the dock 100 in the position above the water line. The support legs 104 typically include fastening hardware 106 which mounts to the dock sections and receives the support legs 104. The hardware 106 typically includes retainers which adjust the position where the hardware is supported on the legs 104 so that the dock sections 102 may be raised and lowered depending on the depth of the water. It can be appreciated that the same hardware 106 and the support legs 104 are mountable to the sides of the storage device base 24. As shown most clearly in FIG. 12, it can be appreciated that the storage device 20 in the preferred embodiment has the same length and width as a typical dock section so that it may be mounted to the side of one section. In addition, the dock sections 102 may be staggered with the storage device 20 for added stability.

Although the storage devices 20 and 200 are self supporting on one set of legs 104, and have their own base, thereby eliminating the need for another dock section 102, it can be appreciated that the storage device may be attached to the dock section using clamps 70 providing additional rigidity and to minimize relative movement. These clamps 70 are hidden from view and attach below the upper surface of the dock 100 and the storage device 20 or 200 in a preferred embodiment, as shown in FIG. 14. In this manner, the storage device 20 or 200 is securely anchored to the dock 100 while the doors are able to swing fully open so as not to block the walking path on an adjacent dock section.

It can be appreciated that with the rounded edges on the enclosure of the storage device 20 or 200, the storage device will not deteriorate in the elements or be easily blown away by high winds. It can further be appreciated that the storage device 20 or 200 may be easily installed and removed when the other components of the dock system are installed and removed in the same manner using non-permanent anchoring and bracing. However, the storage device may be installed and removed independently of the dock 100 and may be moved to other positions on the dock system.

Although support legs 104 are shown, it can be appreciated that for use with floating docks, the storage device 20 or 200 may be fitted with pontoons or other floatation devices. The storage device 20 or 200 can also accommodate auger type anchoring systems such as are commonly used with dock systems. The clamps 70 maintain the storage device 20 or 200 attached to the dock 100 for improved safety. It can be appreciated that when the doors 28 or 208 on the storage device are closed, the use of the dock is entirely unimpeded, as the entire walking path remains open.

The present invention provides for a self-contained modular storage container which increases the utility of the dock 100. The storage devices 20 and 200 easily attach to standard docks in modular fashion and act as an extension of the dock 100. Although the storage devices 20 and 200 are not permanently affixed like boat houses, they provide a temporary, safe storage device rather than the inadequate security provided with typical dock boxes. The storage devices 20 and 200 are installed and removed as easily as the other components of the dock system and further provides a device which does not require a special building permit or zoning permits.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A storage apparatus for use with a dock extending over a surface of a body of water, comprising:

an enclosure having a door on a first side of the enclosure;

a base supporting the enclosure and forming a floor extending substantially across the interior of the enclosure;

means for attaching the enclosure to the dock comprising connectors engaging the base at the first side and an edge of the dock below an upper surface of the dock; wherein the first side is proximate the dock.

2. A storage apparatus according to claim 1, wherein the dock is supported on fixed legs and wherein the enclosure is supported on fixed legs.

3. A storage apparatus according to claim 1, wherein the storage apparatus is removable from the dock.

4. A storage apparatus according to claim 1, wherein the storage apparatus comprises a modular unit interchangeable with sections of the dock.

5. A storage apparatus according to claim 1, wherein the enclosure comprises laminated panels.

6. A storage apparatus according to claim 1, wherein the base has width and length dimensions substantially equal to a standard dock section.

7. A dock system storage module configured for being retained proximate a side of a dock over a body of water, the module having an enclosure with a door and means for attaching the module to the dock at a position below an upper surface of the dock, wherein the module is retained with the door proximate the dock and wherein the enclosure includes a base with supports for maintaining the enclosure above the water.

8. A dock system storage module according to claim 7, wherein enclosure comprises lightweight laminated panels inserting into connecting channel members along their edges.

9. A dock storage module according to claim 8, wherein the connecting channel members comprise rounded edges and corners.

10. A dock storage module according to claim 8, wherein the panels adhesively attach to the connecting channels members.

11. A dock storage module according to claim 8, wherein the connecting channel members include inward protruding portions gripping the panels.

12. A dock system storage module configured for being retained proximate a side of a dock over a body of water, the module having an enclosure having lightweight laminated panels inserting into connecting channel members along their edges, and a door; wherein the module is retained with the door proximate the dock and wherein the enclosure includes a base with supports for maintaining the enclosure above the water, including means for attaching the module to the dock at a position below an upper surface of the dock.

13. A non-floating modular dock system for bodies of water, comprising:

a plurality of dock section units connectable in an end to end configuration;

legs supporting the dock section units above the water at a fixed position;

a storage unit attachable to a side of one or more dock section units below an upper surface of the dock sections, the storage unit having a base and an enclosure;

legs supporting the storage unit above the water at a fixed position.

14. A modular dock system according to claim 13, wherein the dock section units and the storage unit are supported on fixed legs.

15. A modular dock system according to claim 13, wherein the storage unit base forms a floor extending substantially across the interior of the storage unit.

* * * * *